US006516158B2

(12) United States Patent
Saito

(10) Patent No.: US 6,516,158 B2
(45) Date of Patent: Feb. 4, 2003

(54) IMAGE FORMING APPARATUS AND PROCESS CARTRIDGE COMPRISING A CHARGING MEMBER FOR CHARGING AN IMAGE BEARING MEMBER THROUGH CONTACT WITH THE IMAGE BEARING MEMBER

(75) Inventor: Seiji Saito, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/866,601

(22) Filed: May 30, 2001

(65) Prior Publication Data

US 2002/0037172 A1 Mar. 28, 2002

(30) Foreign Application Priority Data

Jun. 1, 2000 (JP) ..... 2000-164828

(51) Int. Cl.[7] ..... G03G 15/00; G03G 15/02

(52) U.S. Cl. ..... 399/12; 399/13; 399/50; 399/89

(58) Field of Search ..... 399/12, 13, 31, 399/50, 89, 174, 176

(56) References Cited

U.S. PATENT DOCUMENTS

| | | | | |
|---|---|---|---|---|
| 5,144,368 A | | 9/1992 | Ohzeki et al. | |
| 5,636,009 A | | 6/1997 | Honda et al. | 399/50 |
| 6,144,812 A | * | 11/2000 | Ueno | 399/12 |
| 6,229,970 B1 | * | 5/2001 | Onimura et al. | 399/50 |

* cited by examiner

*Primary Examiner*—William J. Royer
(74) *Attorney, Agent, or Firm*—Fitzpatrick, Cella, Harper & Scinto

(57) ABSTRACT

A process cartridge detachably mountable to a main body of an image forming apparatus, includes an image bearing member, a charging member for charging the image bearing member while the charging member is in contact with the image bearing member, and a storage device for storing information concerning the type of the charging member.

23 Claims, 4 Drawing Sheets

IMAGE FORMING APPARATUS AND PROCESS CARTRIDGE COMPRISING A CHARGING MEMBER FOR CHARGING AN IMAGE BEARING MEMBER THROUGH CONTACT WITH THE IMAGE BEARING MEMBER

BACKGROUND OF THE INVENTION

1. Field of the Invention

The present invention relates to an image forming apparatus, such as an electrophotographic copier or a laser printer, and a process cartridge detachably mountable to this apparatus.

2. Related Background Art

Conventionally, for an image forming apparatus that performs an electrophotographic image forming process, a process-cartridge system is employed for which process means (a process unit), which acts on an electrophotographic photosensitive body that serves as an image bearing member, is an integrally formed component of a cartridge that can be detachably mounted within the main body of an image forming apparatus. The use of such a cartridge provides a considerable improvement in operability, because apparatus maintenance can be performed by the user. As a result, cartridge-process systems are widely employed for image forming apparatuses today.

Presently, depending on the application, multiple types of process units are employed for the process cartridge that is mounted within the main body of an image forming apparatus.

For this process cartridge, however, since manufacturing dispersions tend to affect the capabilities of multiple process units, the margin allowed for maintaining image quality is increased, which imposes a great restriction on the determination of the process condition.

An example electrophotographic image forming apparatus that employs a contact charging device will now be described while referring to FIG. 5.

A photosensitive drum 101, which is an electrophotographic photosensitive body, is rotated in a direction indicated by an arrow A while its surface is charged by a charge roller 120, which is an electrically coupled charging means that, by the application of a predetermined force, is pressed against and rotates with the photosensitive drum 101. To charge the photosensitive drum 101, a power source 121, as a power supply means, supplies a vibration voltage (vibration bias), obtained by the superimposition of an alternating-current bias and a direct-current bias, to the charge roller 120. Once the surface of the photosensitive drum 101 has been uniformly charged in this manner, in accordance with image data, a laser beam L forms an electrostatic latent image thereon.

Thereafter, a developing device 110, which is developing means, attaches a toner T, which is a developer, to the electrostatic latent image on the photosensitive drum 101, forming a toner image that is transferred to a recording sheet 104, composed of a transferring material, by a transfer roller 102. The recording sheet 104 is then conveyed to a fixing apparatus (not shown) at which it is heated to permanently fix the toner image to the recording sheet 104.

Once the transfer process has been completed, a cleaner 131, which is cleaning means, removes residual toner from the photosensitive drum 101, and prepares the photosensitive drum 101 for use for image forming.

In this example, the photosensitive drum 101, the charge roller 120, the developing device 110 and the cleaner 131 are integrally formed components of a process cartridge B that, by using attachment means 150, is detachably mounted within the main body of the image forming apparatus.

Two different formulas or manufacturing methods are used for fabricating the charge roller 120 employed for the image forming apparatus in this example. According to the first formula (formula A), for the charge roller 120, a rubber layer is formed by using a rubber, such as EPDM, wherein carbon is dispersed, and according to the second formula (formula B), a rubber layer is formed by using polyurethane rubber wherein carbon is dispersed.

When a different formula is used to form the charge roller 120, the following problem occurs.

Since, as is shown in FIG. 3, the characteristics of the formulas used for the charge roller 120 differ, the electrical properties will also vary. And because of the dispersion in the electrical properties, the amount of discharge current, which greatly affects the service life of the photosensitive drum 101, will be altered. And finally, the service life of the photosensitive drum 101 will also differ due to the difference in the charge roller 120. That is, a dispersion will also appear in the service life of the process cartridge B.

Then, since a characteristic such as the charging performance is also varied, the potential applied to the photosensitive drum 101 is changed, and there is a dispersion in the image quality.

As is described above, when the formula for the charge roller differs, a dispersing occurs in the service life of the photosensitive drum or the process cartridge that also affects the image quality.

SUMMARY OF THE INVENTION

It is, therefore, one objective of the present invention to provide a process cartridge and an image forming apparatus, wherein a change in potential at an image bearing member, which is due to a charging member, is reduced.

It is another objective of the present invention to provide a process cartridge and an image forming apparatus for which information concerning the type of charging member employed is stored in storage means.

It is an additional objective of the present invention to provide a process cartridge and an image forming apparatus for which dispersions in the service lives of the image bearing member and the process cartridge that are due to a charging member are eliminated.

It is a further objective of the present invention to provide a process cartridge and an image forming apparatus whereby and wherein, for an extended period of time, images can be stably formed for which there are no dispersions in quality that are due to a charging member.

Other objectives and features of the invention will become apparent during the course of the following detailed explanation, given while referring to the accompanying drawings.

DETAILED DESCRIPTION OF THE PREFERRED EMBODIMENTS

An image forming apparatus according to the present invention will now be described in detail while referring to the accompanying drawings.

First Embodiment

A first embodiment for the invention will now be described while referring to FIGS. 1 to 3.

First, an image forming apparatus, which for this embodiment is a printer, will be explained while referring to FIG. 1.

Figure 1:
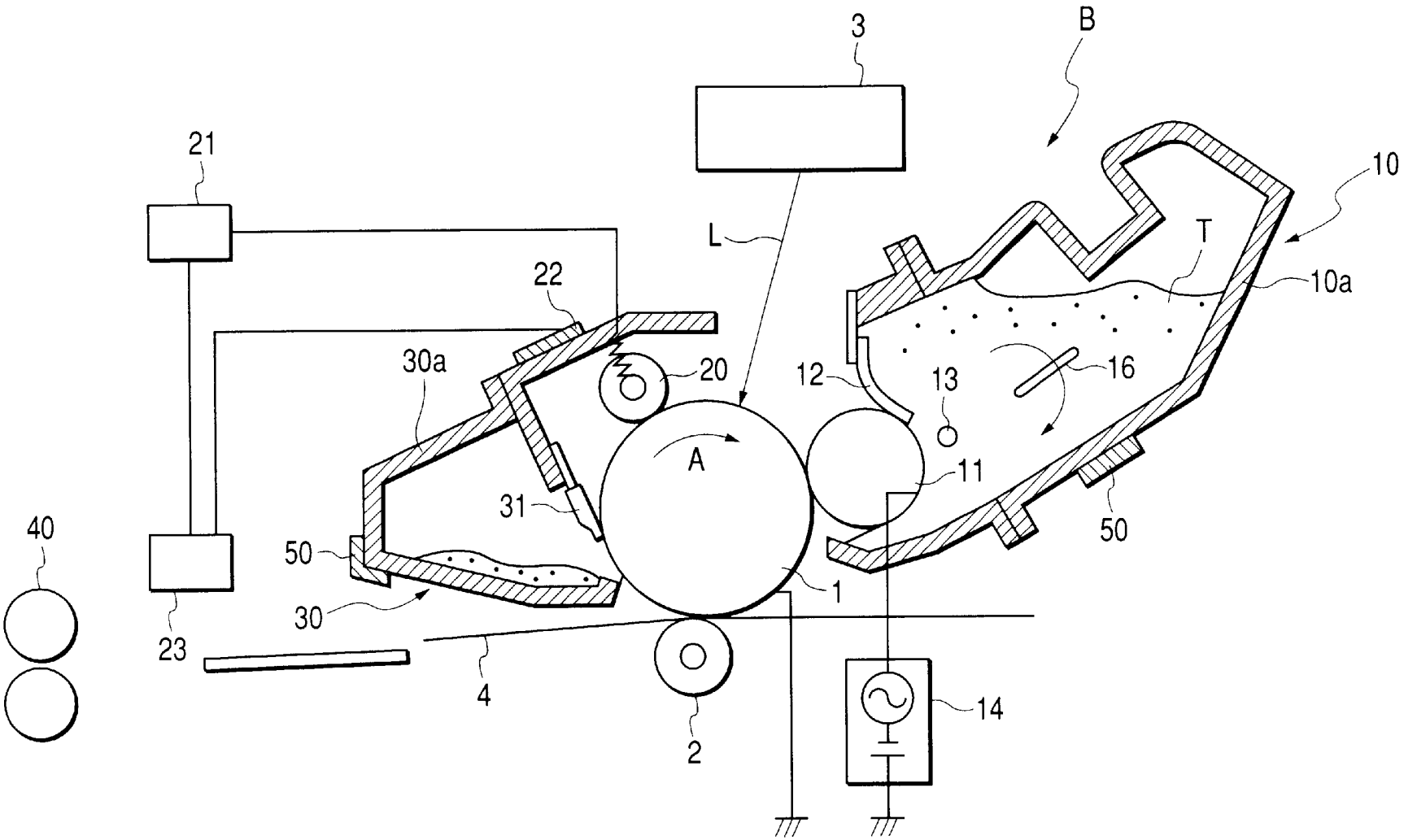
FIG. 1 is a diagram showing the configuration of an image forming apparatus according to one embodiment of the present invention.

As is shown in FIG. 1, the printer in this embodiment comprises: a photosensitive drum 1, (image bearing member) which, as an electrophotographic photosensitive body, is located substantially in the center; a developing device 10, which serves as developing means; a transfer roller 2, which is transfer means; a cleaning device 30, which is cleaning means and includes a cleaning blade 31; a laser emission/exposure device 3, which, as exposing means, is located above; and a fixing device 40, which, as fixing means, is located on the left in FIG. 1.

The developing device 10 contains, in a toner container 10*a,* magnetic one-component toner T, a developer, and a developing roller 11, which is a non-contact and rotatable developer carrying member and is located at the opening of the toner container 10*a* opposite the photosensitive drum 1. At the opening of the toner container 10*a,* a regulating blade 12 is also positioned as a developer layer regulating member for controlling the thickness of the layer of the toner T carried by the developing roller 11. In addition, a magnet (not shown), fixed inside the developing roller 11, attracts the toner T on the circumferential surface of the developing roller 11 so it is not detached while being carried to a development area.

Furthermore, in the toner container 10*a,* arranged parallel to the developing roller 11, is an antenna 13, for detecting the amount of toner T remaining, that signals a user when a predetermined toner level is reached.

In this embodiment, the photosensitive drum 1, the developing device 10, the cleaning device 30 and a charge roller 20 (charging member) constitute integral components of a process cartridge B, which is detachably retained by attachment means 50 and can be removed and replaced when its service life has expired.

As is shown in FIG. 1, not only the laser emission/exposure device 3, the transfer roller 2 and the fixing, device 40, but also a bias power source 21 that supplies power to the charge roller 20, a development bias power source 14 for the developing roller 11, a CPU 23 for providing overall operational control and recording sheet conveying means (not shown) are provided for the main body of the image forming apparatus.

The photosensitive drum 1 is rotated in the direction indicated by an arrow A while its surface is charged by the charge roller 20, which is electrically coupled with and, by the application of a predetermined force, is pressed against and rotates with the photosensitive drum 1. To charge the photosensitive drum 1, a vibration voltage (vibration bias) is obtained by superimposing an alternating-current bias component and a direct-current bias component and is supplied to the charge roller 20 by the bias power source 21. Once the photosensitive drum 1 has been uniformly charged in this manner, in accordance with image data, a laser beam L irradiates the photosensitive drum 1 and forms an electrostatic latent image thereon.

In the developing device 10, the toner T is agitated by an agitation member 16 in the toner container 10*a,* and is carried to the developing roller 11. There, the friction produced by the rotation of the developing roller 10, or between it and the regulating blade 12, applies a predetermined charge to the toner T carried on the circumferential surface of the developing roller 11.

An AC bias and DC bias superimposed voltage is applied to the developing roller 11 by the development bias power source 14 to obtain a potential difference between the developing roller 11 and the electrostatic latent image on the photosensitive drum 1, so that toner T is transferred from the developing roller 11 to the electrostatic latent image and a toner image is developed.

The toner image on the photosensitive drum 1 is transferred by the transfer roller 2 to a transferring material, a recording sheet 4, that is then conveyed to the fixing device 40, at which the toner image is permanently fixed to the recording sheet 4. Thereafter, the recording sheet 4 is stacked outside the image forming apparatus.

The residual toner on the photosensitive drum 1 is removed by the cleaning blade 31, and is collected in the cleaning container 30*a.*

Figure 2:
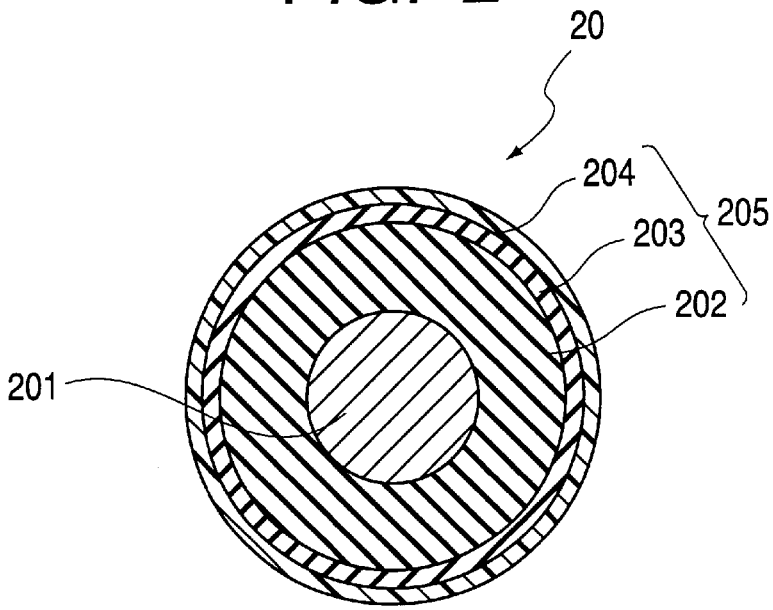
FIG. 2 is a cross-sectional view of a charge roller according to the embodiment of the invention.

As is shown in FIG. 2, the charge roller 20 of the embodiment comprises a metal core 201 that is covered by a roll base 205. The roll base 205 is composed of a conductive rubber layer base material 202 whereon a resist layer 203 is formed that is covered by a protective surface layer 204.

In this embodiment, according to the first formula (hereinafter referred to as "formula A"), i.e., a manufacturing method, the base material 202 is a conductive rubber layer formed of EPDM wherein a conductive agent is dispersed, the resist layer 203 is a layer formed of hydrin rubber wherein a conductive agent is dispersed, and the surface layer 204 is a layer formed of Toresin (the product name of the methoxymethyl nylon produced by Teikoku Chemical Industry Co., Ltd.) wherein a conductive agent is dispersed.

According to the second formula (hereinafter referred to as "formula B"), the base material 202 is conductive rubber layer formed of isoprene rubber wherein a conductive agent is dispersed, the resist layer 203 is a layer formed of isoprene rubber wherein a conducive agent is dispersed, and the surface layer 204 is a layer formed, as in formula A, of Toresin wherein a conducive agent is dispersed.

Figure 3:
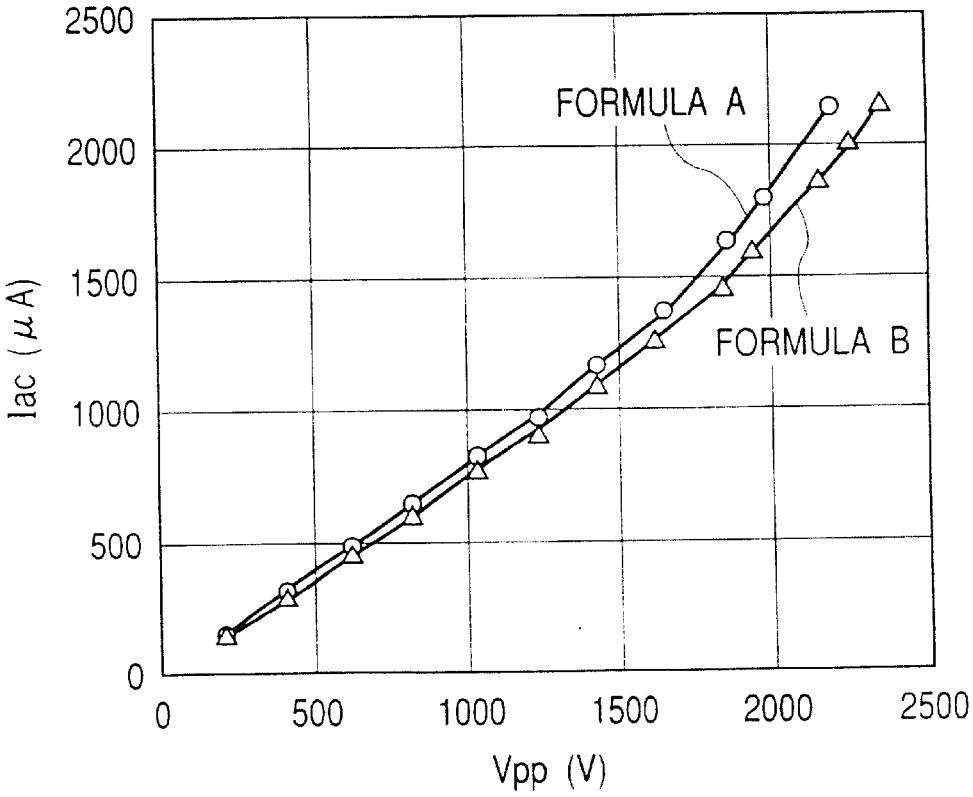
FIG. 3 is a graph showing VI curves for formulas A and B for the charge roller.

As is illustrated by the VI curves in FIG. 3, these formulas, A and B, have different electrical characteristics.

In this embodiment, therefore, the bias to be applied to the charge roller 20 is so set that the service life of the photosensitive drum 1 is extended to the maximum, and in a low temperature, low humidity environment, for example, no deterioration of the image quality occurs. In this embodiment, as the result of experimentation, the setup values shown in Table 1 were obtained as values that satisfy the above conditions.

TABLE 1

| formula/setup value | AC bias $V_{p-p}$ (V) | DC bias $V_{cdc}$ (V) |
|---|---|---|
| A | 1800 | −700 |
| B | 1900 | −690 |

With these setup values, the amount of discharge current generated at the gap between the photosensitive drum 1 and the charge roller 20 and the charge potential of the photosensitive drum 1 are constant, regardless of whether formula A or B was used. That is, the service life of the photosensitive drum 1 and the image quality provided by the process cartridge B can be maintained at the same level, regardless of whether formula A or formula B is used to form the charge roller 20.

An explanation will now be given for a method used to identify or determine which charge roller, either the one for formula A or the one for formula B, is included in a process cartridge B.

As is shown in FIG. 1, the process cartridge B in this embodiment includes a nonvolatile memory 22 that serves as storage means in which the formula used and the characteristic of the charge roller 20 can be stored. It should be noted that, during the assembly of the process cartridge B, the information for the formula and the characteristic of the charge roller 20 is stored in the nonvolatile memory 22, and that this memory 22 is mounted in the process cartridge B.

When the process cartridge B is mounted in an image forming apparatus, the CPU 23 in the main body of the apparatus reads and fetches the information concerning the charge roller 20 that is stored in advance in the nonvolatile memory 22. In the image forming process, at the setup values for the AC bias and DC bias shown in Table 1, the photosensitive drum 1 is charged by the charge supplied to the charge roller 20 by the bias power source 21 in the main body.

As is described above, according to the embodiment, a dispersion in the service life of the photosensitive drum or the process cartridge, or a dispersion in the image quality, which is due to the charge roller, can be eliminated.

The nonvolatile memory can be variously used for purposes other than for the above described identification of the process unit in a process cartridge. For example, the rotation time for the photosensitive drum as the image forming process is advanced, and the application time for a bias for the charging can be cumulatively stored, so that the service life of the process cartridge can be accurately determined, and the usability can be enhanced.

Second Embodiment

Figure 4:
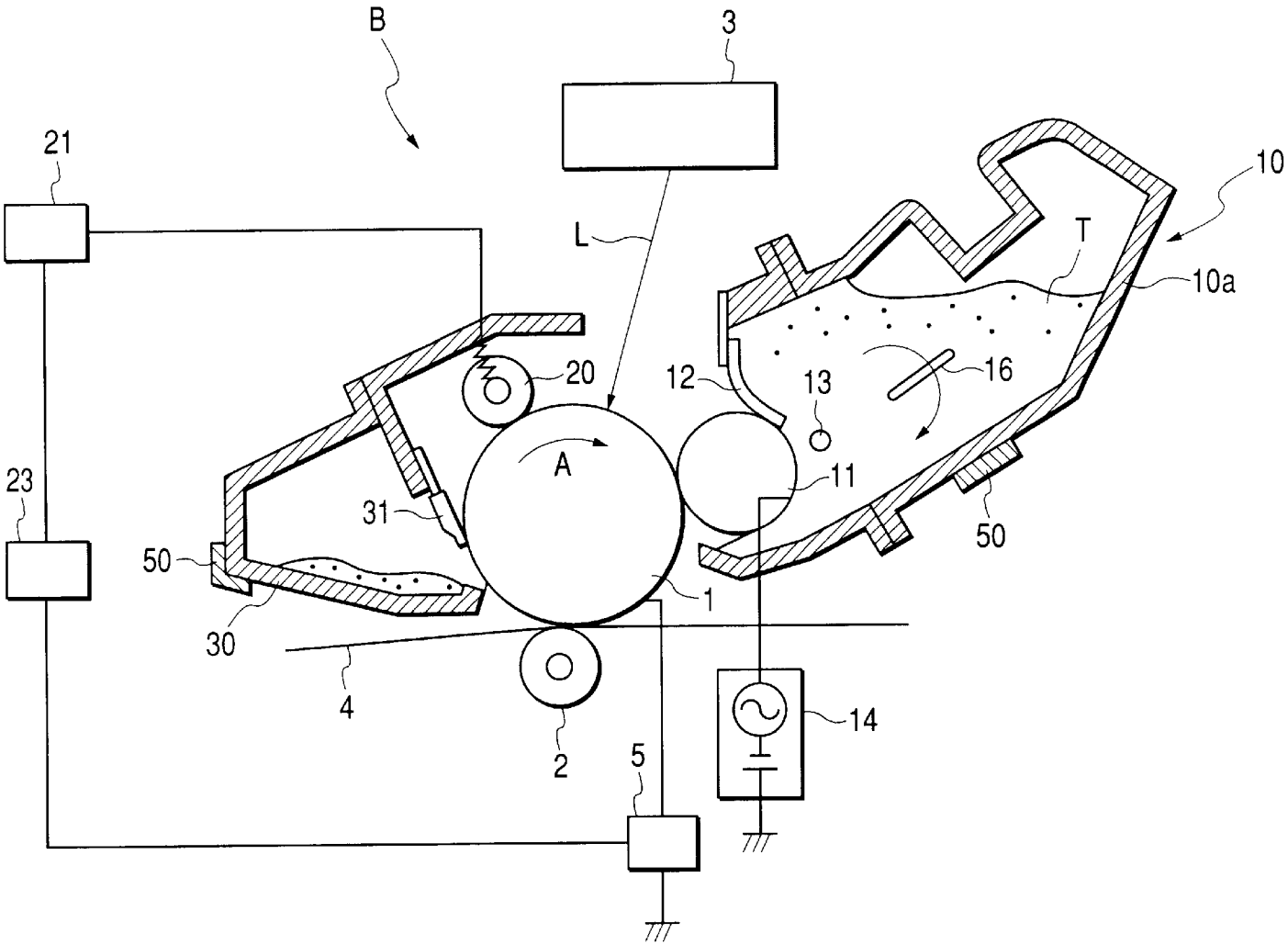
FIG. 4 is a diagram showing the configuration of an image forming apparatus according to another embodiment of the invention.
Figure 5:
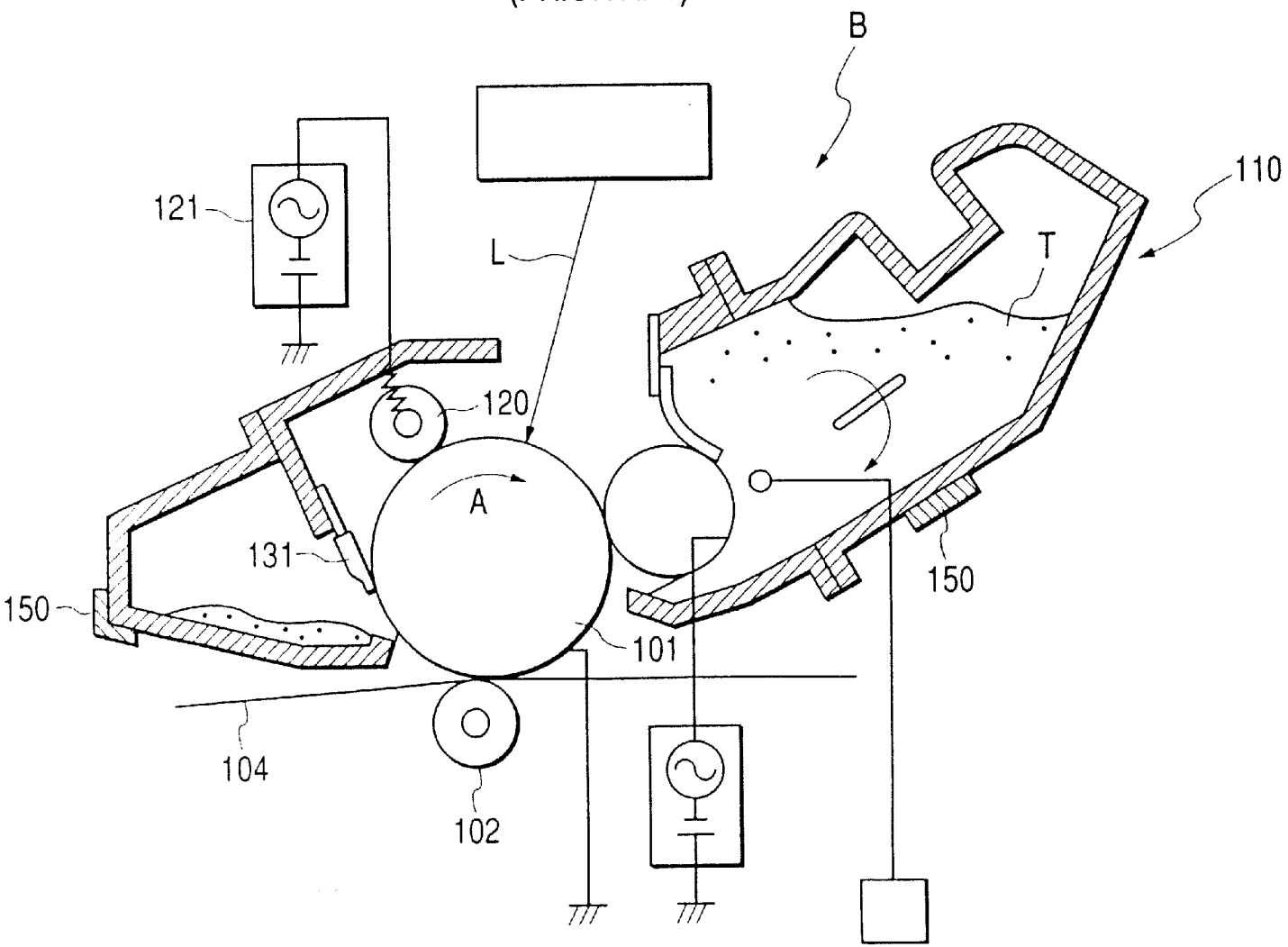
FIG. 5 (PRIOR ART)
FIG. 5 is a schematic diagram showing the configuration of a conventional image forming apparatus.

A second embodiment of the present invention will now be descried while referring to FIG. 4. Since, in this embodiment, the configuration and operation of an image forming apparatus and the structure and the formula used for the charging means, i.e., a charge roller, are substantially the same as those for the first embodiment, no further explanation for them will be given, and only those portions that are different will be described.

According to a method for determining the formula used for the charge roller 20 in this embodiment, when a process cartridge B in the initial state is mounted in an image forming apparatus, the resistance of the charge roller 20 is measured to determine the formula used for the charge roller 20.

Specifically, as is shown in FIG. 4, an effective value sensor 5 (discriminating means) is included as effective value-detection means for detecting the effective value of a current that flows from the charge roller 20 to the photosensitive drum 1.

When the process cartridge B in the initial state is mounted in the main body of the image forming apparatus, the process cartridge B starts blank rotation before the image forming process is begun. During this blank rotation, the vibration bias obtained by superimposing the AC bias and the DC bias is applied to the charge roller 20 by the bias power source 21. In this embodiment, $V_{pp}$=2000 V and $V_{dc}$=−700 V. At this time, the effective value sensor 5 detects the effective value of a current that flows from the charge roller 20 to the photosensitive drum 1. The detected effective value of the current is compared with a reference value that is stored in advance in the CPU 23 of the image forming apparatus, and a formula difference is identified.

That is, since the effective value of a current detected by the effective value sensor 5 differs depending on the formula used for the charge roller 20, a formula difference for the charge roller 20 can be identified by comparing the effective value with the reference value stored by the CPU 23.

In this embodiment, since upon the application of the vibration bias the effective values of the currents detected are 1800 $\mu$A for formula A and 1650 $\mu$A for formula B, an intermediate value for the two, 1750 $\mu$A, is stored as a reference value in the CPU 23. The formula used can thus be determined by comparing the reference value with the effective value obtained for the current detected by the effective value sensor 5, and the image forming process can then be performed using the setup values in Table 1.

In this embodiment, the same effects as in the first embodiment can be obtained.

As is apparent from the above explanation, the detecting means for determining the type of charge roller is included, and in accordance with the detecting results obtained by the discriminating means, the AC bias and the DC bias inherent to the charge roller is applied to the charge roller by the power source. Thus, a dispersion in the service life of the electrophotographic photosensitive drum or the process cartridge, and a dispersion in the image quality, both of which are due to the charge roller, can be eliminated, and a stable image forming process can be performed for an extended period of time.

What is claimed is:

1. A process cartridge detachably mountable to a main body of an image forming apparatus comprising:

an image bearing member;

a charging member for charging said image bearing member while said charging member is in contact with said image bearing member, wherein one type of said charging member is selected from plural types to be provided for each said process cartridge; and storage means for storing information concerning the selected type of said charging member.

2. A process cartridge according to claim 1, wherein a voltage is permitted to be applied to said charging member by a power source provided in said main body, and wherein said voltage is capable of being determined in accordance with said information stored in said storage means.

3. A process cartridge according to claim 2, wherein said voltage includes a direct-current component and an alternating-current component.

4. A process cartridge according to claim 3, wherein said direct-current component and said alternating-current component are capable of being determined in accordance with said information stored in said storage means.

5. A process cartridge according to claim 1, wherein said storage means is a nonvolatile memory.

6. A process cartridge according to claim 1, wherein said image bearing member is an electrophotographic photosensitive body.

7. A process cartridge according to claim 1, wherein the stored information on the type of said charging member relates to an electrical characteristic of said charging member.

8. A process cartridge according to claim 1, wherein the type of said charging member is a material of said charging member.

9. An image forming apparatus comprising:

an image bearing member;

a charging member for charging said image bearing member while said charging member is in contact with said image bearing member, wherein one type of said charging member is selected from plural types to be provided for each apparatus;

a power source for applying a voltage to said charging member; and storage means for storing information concerning the selected type of said charging member, wherein said voltage is determined in accordance with said information stored in said storage means.

10. An image forming apparatus according to claim 9, wherein said voltage includes a direct-current component and an alternating-current component.

11. An image forming apparatus according to claim 10, wherein said direct-current component and said alternating-current component are determined in accordance with said information stored in said storage means.

12. An image forming apparatus according to claim 9, wherein said storage means is a nonvolatile memory.

13. An image forming apparatus according to claim 9, wherein said image bearing member is an electrophotographic photosensitive body.

14. An image forming apparatus according to claim 9, wherein the stored information on the type of said charging member is an electrical characteristic of said charging member.

15. An image forming apparatus comprising:

an image bearing member;

a charging member for charging said image bearing member while said charging member is in contact with said image bearing member, wherein one type of said charging member is selected from plural types to be provided for each apparatus;

a power source for applying a voltage to said charging member; and discriminating means for discriminating the selected type of said charging member, wherein said voltage is determined in accordance with the discrimination result by said discriminating means.

16. An image forming apparatus according to claim 15, wherein said voltage includes a direct-current component and an alternating-current component.

17. An image forming apparatus according to claim 16, wherein said direct-current component and said alternating-current component are determined in accordance with the discrimination result by said discriminating means.

18. An image forming apparatus according to claim 15, wherein said image bearing member is an electrophotographic photosensitive body.

19. An image forming apparatus according to claim 15, wherein the stored information on the type of said charging member relates to an electrical characteristic of said charging member.

20. An image forming apparatus according to claim 15, wherein the type of said charging member is a material of said charging member.

21. An image forming apparatus comprising:

an image bearing member;

a charging member for charging said image bearing member while said charging member is in contact with said image bearing member;

a power source for applying, to said charging member, a voltage including an alternating-current component and a direct-current component; and detection means for detecting a current that flows from said charging member to said image bearing member, wherein said alternating-current component and said direct-current component are determined in accordance with said current detected by said detection means.

22. An image forming apparatus according to claim 21, wherein said current is an effective value of an alternating current.

23. An image forming apparatus according to claim 21, wherein said image bearing member is an electrophotographic photosensitive body.

* * * * *